US005518148A

United States Patent [19]

Smrt

[11] Patent Number: 5,518,148

[45] Date of Patent: May 21, 1996

[54] HANDLE FOR HOLDING AND REMOTELY ACTUATING AN AEROSOL CONTAINER

[76] Inventor: Thomas J. Smrt, 9716 S. Grant Hwy., Marengo, Ill. 60152

[21] Appl. No.: 298,418

[22] Filed: Aug. 30, 1994

Related U.S. Application Data

[63] Continuation-in-part of Ser. No. 156,025, Nov. 19, 1993, Pat. No. 5,368,202.

[51] Int. Cl.[6] ..... B67D 5/64

[52] U.S. Cl. ..... 222/174; 222/402.14

[58] Field of Search ..... 222/174, 402.14, 222/323, 402.15, 473, 474

[56] References Cited

U.S. PATENT DOCUMENTS

| | | | |
|---|---|---|---|
| 2,720,422 | 10/1955 | Mercur | 222/174 |
| 2,893,606 | 7/1959 | Hawkins | 222/174 |
| 3,229,859 | 1/1966 | Conroy et al. | 222/174 |
| 3,485,206 | 12/1969 | Smrt | 222/174 |
| 3,510,028 | 5/1970 | Batistelli | 222/174 |
| 3,716,195 | 2/1973 | Silva | 222/174 |
| 3,861,566 | 1/1975 | Wentzell | 222/174 |
| 3,977,570 | 8/1976 | Smrt | 222/174 |
| 4,023,711 | 5/1977 | Sena | 222/174 |
| 4,092,000 | 5/1978 | Offutt, III | 239/532 |
| 4,099,482 | 7/1978 | Smrt | 222/174 |
| 4,417,673 | 11/1983 | Hancock | 222/153 |
| 4,660,745 | 4/1987 | Hess, Jr. | 222/174 |
| 4,856,596 | 8/1989 | Hamernik | 222/402.14 |
| 4,886,191 | 12/1989 | Yoshitomi | 222/174 |
| 5,368,202 | 11/1994 | Smrt | 222/174 |

OTHER PUBLICATIONS

Smrt, Fox Valley Systems, Inc., "We thought of it, we invented it, we patented it... 25 Years of... easy marker®'s great useful features . . . " brochure.

*Primary Examiner*—Andres Kashnikow
*Assistant Examiner*—Philippe Derahshani
*Attorney, Agent, or Firm*—Leydig, Voit & Mayer, Ltd.

[57] ABSTRACT

A spraying apparatus for discharging the contents of a valve-equipped aerosol can comprising: an elongated, hollow tube having a front and rear end; a front housing fixed to the tube at the front end, the front housing including a can holder comprising a hollow cylinder sized to receive an aerosol can; a bell crank pivotally mounted in the front housing; a trigger rod fixed to a first arm of the bell crank, an actuator rod fixed to a second arm of the bell crank and mounted within the first housing for longitudinal movement between a discharging position, and a non-discharging position; a biasing spring fixed between the trigger rod and a retaining wall in the front housing; a rear housing mounted to the rear end of the tube the rear housing including a grip portion; a trigger disposed within the rear housing and connected to the trigger rod for reciprocating horizontal movement between a discharging position and a non-discharging position; and a locking land disposed within the rear housing for frictionally receiving a front surface of the trigger when it is moved vertically from the discharging position, the biasing spring biasing the trigger into engagement with the locking land and thus maintaining the trigger in the discharging position.

3 Claims, 6 Drawing Sheets

HANDLE FOR HOLDING AND REMOTELY ACTUATING AN AEROSOL CONTAINER

RELATED APPLICATIONS

This application is a continuation-in-part of my prior, application, U.S. Ser. No. 08/156,025 filed Nov. 19, 1993 now U.S. Pat. No. 5,368,202 issued Nov. 29, 1994.

FIELD OF THE INVENTION

This invention relates to a device for remotely supporting and actuating an aerosol container.

BACKGROUND OF THE INVENTION

Aerosol containers using a pressurized gas for dispensing various types of products are used in a variety of environments. Examples of such products include paints, insecticides, cleaning and lubricating compositions. Because of the pressure capacity of conventional spray cans is limited, the spray discharged from the can is typically only discharged through a limited distance. This often requires that the user of the can be positioned relatively close to the article or object which is to be sprayed. While this may suffice for in certain applications, it is very undesirable for others. For instance, when markings are being made on a road or sidewalk, it is very inconvenient for the user to have to bend down toward the road or sidewalk in order to produce a high quality and accurately-located mark. Moreover, if a spray can containing an insecticide is being used on a nest or hive of insects, it would be very undesirable to be in an area immediately adjacent to the hive while the insecticide is applied. Further, and in certain other situations, the contents of the can itself may be harmful if it comes in contact with human skin or is inhaled, this making a further case for locating the can remotely from the user upon discharge.

In an effort to overcome the aforementioned problems, several devices have been devised which permit an aerosol can to be located at a remote distance from the user, and which allow for remote actuation of the spray can. Examples of such known devices are provided by U.S. Pat. Nos. 3,485,206, 3,977,570, 4,099,482 and 4,660,745.

In using such devices, however, the hand of the operator may become fatigued from holding the trigger of the device in the actuating position (the position which causes discharge of the can contents) for an extended period. It would thus be desirable to provide a means by which this problem could be avoided. Moreover, as remote spraying devices are used for a variety of purposes, it would also be desirable to provide a means which, while having an extended spray feature, also includes normal triggering operation which permits intermittent discharging of the can contents, i.e., in relatively short bursts.

Thus, there exists a need for an aerosol can holder which allows for the remote actuation of the can by a user for both an extended period, without fatiguing the user, and for intermittent bursts. The specific advantages of the present invention, as well as additional inventive features, will be apparent from the description of the invention provided herein.

SUMMARY OF THE INVENTION

The present invention provides a spraying apparatus for discharging the contents of a valve-equipped aerosol can comprising: an elongated, hollow tube having a front and rear end; a front housing fixed to the tube at the front end, the front housing including a can holder comprising a hollow cylinder sized to receive an aerosol can; a bell crank pivotally mounted in the front housing; a trigger rod fixed to a first arm of the bell crank, and mounted within the front assembly and tube for sliding longitudinal movement, such movement causing rotation of the bell crank; an actuator rod fixed to a second arm of the bell crank and mounted within the first housing for longitudinal movement between a discharging position, wherein the actuator rod pushes the can valve, and a non-discharging position; a biasing spring fixed between the trigger rod and a retaining wall in the front housing, which biases the trigger rod to a position where the actuator rod is in the non-discharging position; a rear housing mounted to the rear end of the tube the rear housing including a grip portion; a trigger disposed within the rear housing and connected to the trigger rod for reciprocating horizontal movement between a discharging position, wherein the actuator rod is in the discharging position, and a non-discharging position; and a locking land disposed within the rear housing for frictionally receiving a front surface of the trigger when it is moved vertically from the discharging position, the biasing spring biasing the trigger into engagement with the locking land and thus maintaining the trigger in the discharging position.

Other advantages of the present invention will be apparent to persons skilled in the art upon reading the following description and referring to the accompanying drawings.

DETAILED DESCRIPTION OF THE PREFERRED EMBODIMENT

Figure 1:
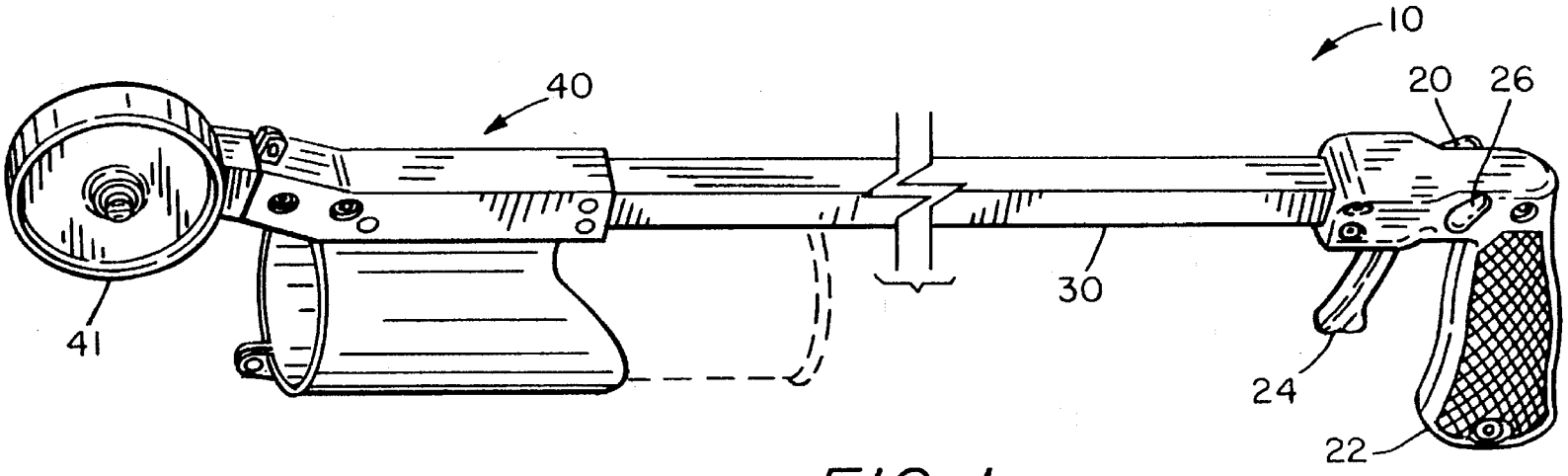
FIG. 1 is a left side perspective view of a first embodiment of a remote spraying device, which includes an optional rotatable wheel, constructed according to the present invention.

Turning initially to FIG. 1, there is illustrated a first embodiment of a remote spraying device 10 according to the present invention. A handle section, or rear housing, 20 includes a grip 22 for manual grasping by the user. Preferably, the rear housing is formed of two mirror-image sections of molded plastic, secured together by any suitable securing means, e.g., rivets. A trigger 24 extends from the rear housing 20 to provide for actuation of the aerosol can disposed at the opposite end of the spraying device 10. The rear housing 20 also includes a lock switch 26 for selectively placing the spraying device in one of two modes. In the first mode, the trigger 24 may only be operated in a conventional fashion, i.e., wherein it must be moved toward the grip in order to cause discharge of the can contents. In the second mode, the trigger may either be operated in a conventional, or intermittent, fashion, i.e, it must be moved toward the grip to cause discharge of the can contents, or the trigger can be placed in a position which provides for continual discharging of the can contents until such time as the trigger is released from this position.

FIG. 1 further discloses an elongate tube 30, either circular, rectangular, or square in cross-section, extends between the rear housing 20 and a front housing 40. The front housing is also preferably formed of two pieces of mirror-image molded plastic which are joined together by any suitable means. The front housing 40 contains several components required for actuation of the aerosol can, as will be discussed below. Front housing 40 also includes a can holder for receiving the aerosol can as well as a rotational wheel 41. The wheel is detachable by a user and, if used, is intended to contact the surface to be sprayed, thereby assisting in maintaining the actuator at a set distance from the surface.

Figure 8:
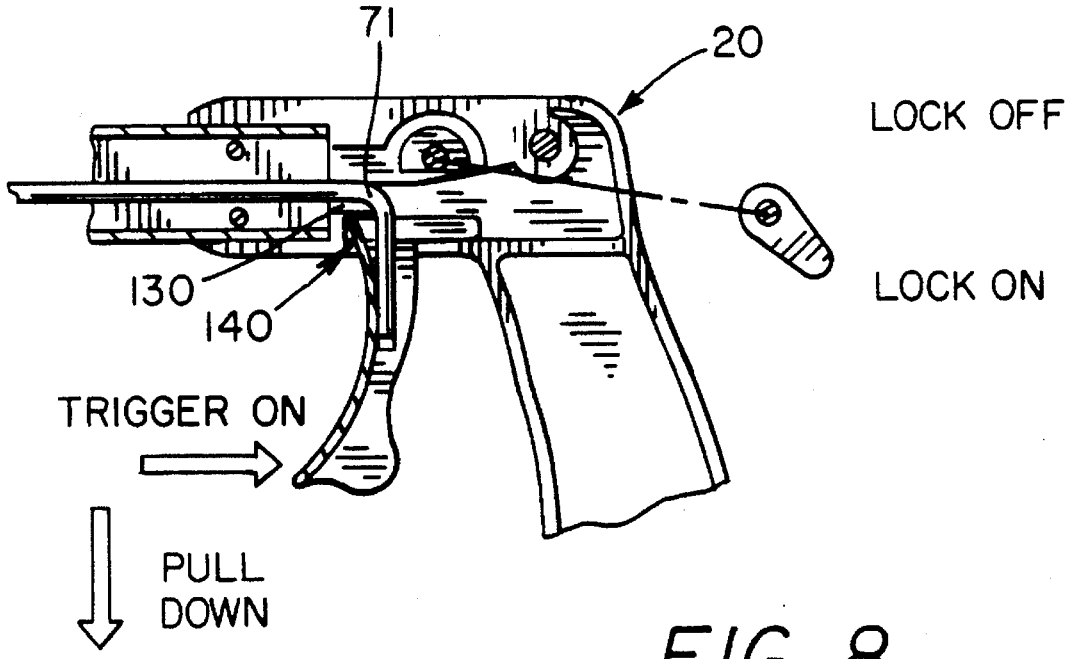
FIG. 8 is a partial view of FIG. 2 showing the trigger and locking mechanism in the locking position and indicating the movement required to place the trigger into the non-locking position from the locking position.
Figure 9:
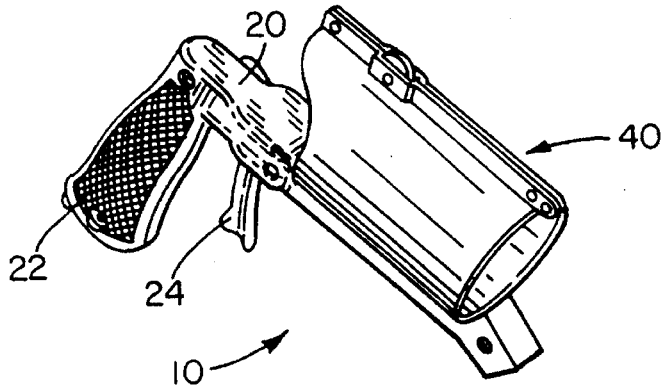
FIG. 9 is a right side perspective view of a second embodiment of a remote spraying device constructed according to the present invention.
Figure 10:
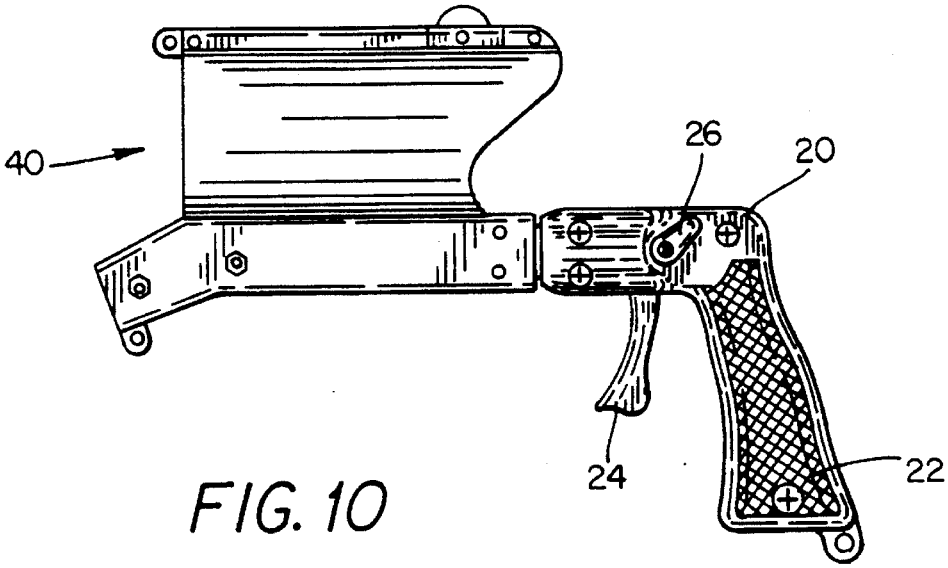
FIG. 10 is a left side plan view of the second embodiment.
Figure 11:
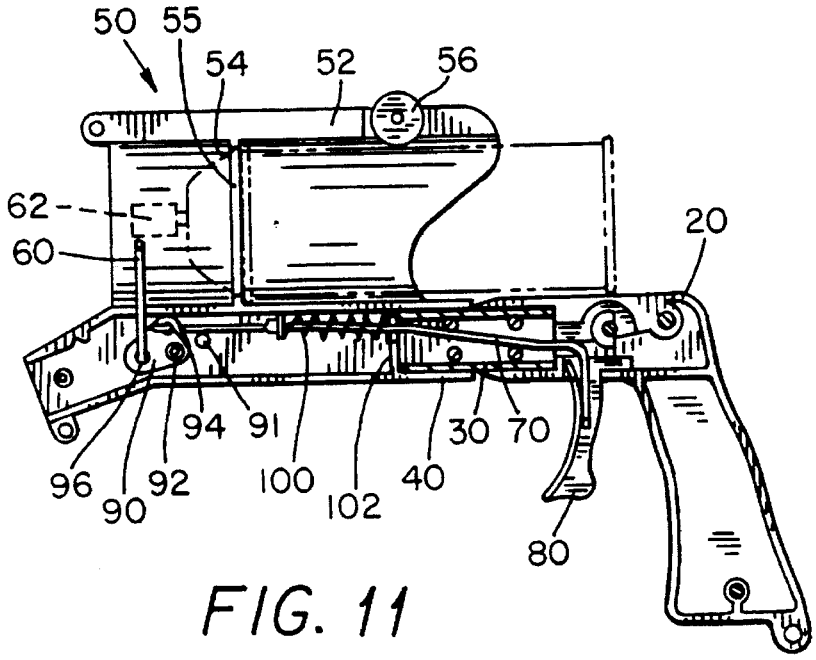
FIG. 11 is a left side longitudinal sectional view of the spraying device of FIG. 9 showing the internal moving components of the device.

Turning to FIG. 9, there is illustrated a second embodiment of the remote spraying device of the present invention. That figure, as well as FIG. 10, depict a remote spraying device 10 which comprise rear and front housings, as described herein. However, as will be appreciated upon referring to FIGS. 9–11, the front housing is rotated 180° about its longitudinal axis with respect to the rear housing (as compared to their orientation in the first embodiment, as best shown in FIG. 1). Further, the elongate tube 30 (shown only in FIG. 11) is sized so as to allow the front and rear housings to be adjacent to one another. Despite the different outward appearance, however, the mechanical operation of the first and second embodiments is identical. As such, the operation and functioning of the various components (in connection with FIGS. 3–8) will be described herein with respect to the first embodiment only. By reference to FIG. 11, and by use of the indicia thereon, however, one will be able to appreciate and understand the operation of the second embodiment.

Figure 2:
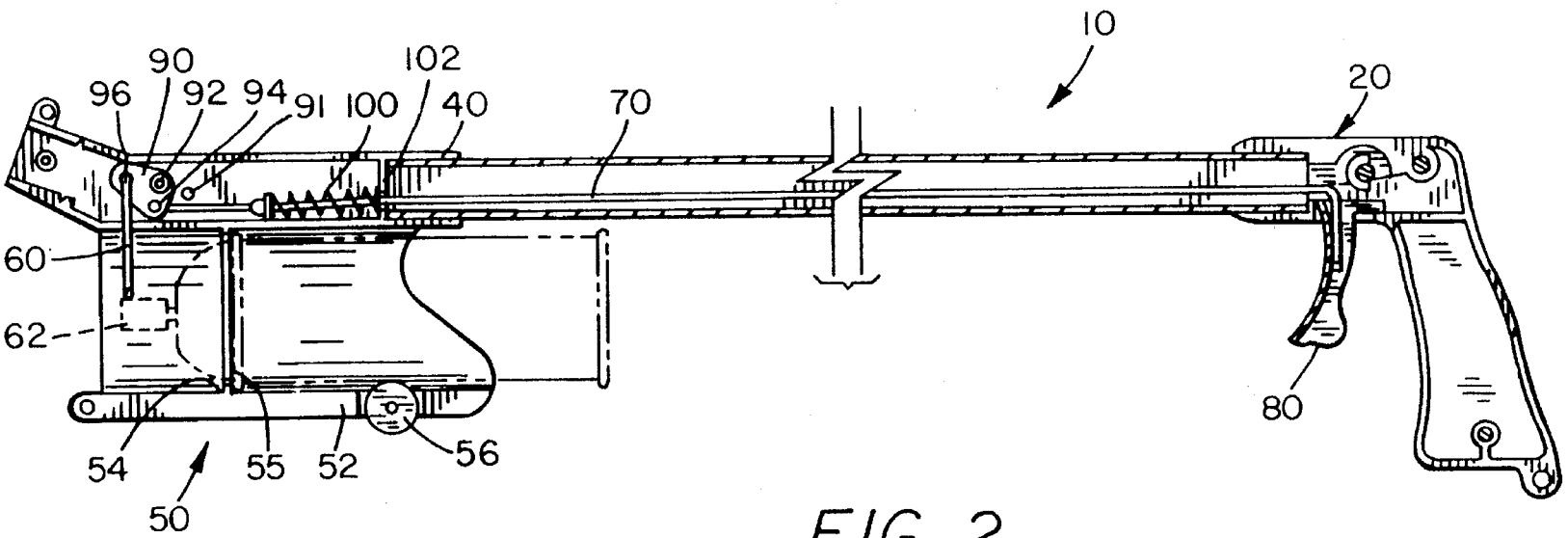
FIG. 2 is a left side longitudinal sectional view of the spraying device of FIG. 1 (without said rotatable wheel) showing the internal moving components of the device.

The means by which the aerosol can is actuated and its contents dispensed will now be described in reference to FIG. 2, which shows a left side sectional view of the moving components of the first embodiment of the remote spraying device 10 according to the invention. See also FIG. 11 which depicts a cross-sectional view of the second embodiment of the present invention.

The front housing 40 includes a can holder designated generally by reference numeral 50. Can holder 50 is comprised of a hollow cylinder 52 fixed to the bottom of housing 40. Cylinder 52 is sized to receive an aerosol can. Within cylinder 52 is an annular retaining wall 54. That wall includes a central opening which allows the top of the can, including the actuator-valve, to extend therethrough. The annular retaining wall is sized so as to contact a ridge portion 55 which extends from a typical aerosol can. Thus, annular retaining wall 54 serves to properly position an aerosol can within the cylinder 52.

The holder 50 further includes a wheel 56 which is rotatably mounted thereto. When a can is inserted into the holder, it will contact the wheel; the wheel turning and providing for smooth and easy insertion of the can into the holder.

To actuate a properly-positioned aerosol can, an actuator rod 60 is provided. The actuator rod 60 is reciprocable in a longitudinal direction between a position wherein it displaces the valve-actuator 62 angularly away from its normal position, so as to cause the contents of the can to be discharged, and a position wherein the valve-actuator 62 is not so displaced (as shown in FIG. 2). For the purposes of this description, the term longitudinal movement will be used to designate movement along a longitudinal axis of a particular component being described. The end of the actuator rod 60 which contacts the actuator is advantageously bent at about 90° with respect to the longitudinal axis of the rod. This provides for better contact between the actuator rod and actuator, ensuring proper actuation of the valve upon use of the handle.

To provide for manual control of the actuation of the valve actuator by actuator rod 60, a triggering mechanism is used. The triggering mechanism includes a trigger rod 70 which is reciprocable longitudinally by movement of a trigger 80 located in rear housing 20, the trigger 80 being fixed to the trigger rod 70. The longitudinal movement of trigger rod 70 is translated into longitudinal movement of actuator rod 60 by means of a bell crank 90. Bell crank 90 is pivotally mounted in the front housing by means of a pivot pin 92. A further pivot pin 94 connects trigger rod 70 and a first arm of the bell crank. A second arm of the bell crank is connected to the actuator rod 60 by means of a further pivot pin 96. Thus, longitudinal movement of trigger rod 70 causes bell crank 90 to pivot about pivot pin 92, thus moving actuator rod 60 in a longitudinal direction. Bell crank stop 91, which is located with respect to the bell crank 90 so as to prevent the actuator rod from moving excessively in the longitudinal direction and damaging the actuator and/or valve assembly, is also provided.

To ensure that the contents of the spray can are only discharged when desired, a biasing spring is used to maintain the actuating mechanism in the non-discharging position. The biasing spring 100 is fixed to the trigger rod 70. That spring is further disposed between this fixed point on the trigger rod and a retaining wall 102, that wall being disposed in the front housing and including a central opening for receiving trigger rod 70. The spring 100 is of the extension type and thus, in the sense of FIG. 2, imparts a biasing force on the trigger rod 70 which tends to move it toward the left. As can be seen from further reference to FIG. 2, a biasing of the trigger rod 70 to the left causes the actuator rod 60 to move into the non-discharging position. A further function of biasing spring 100 will be described below.

To provide for a manual control of the longitudinal motion of the trigger rod, and thus for manual control of actuation of the actuator rod of the device, trigger rod 70 is fixed to a trigger 80. Trigger 80 is housed within rear section 20 for relative movement with respect thereto. As the operation of the trigger 80 and its interaction with various components with the rear section 20 provides some of the significant functional features of this invention, the components housed within rear section 20, and their interaction, will be more fully described in reference to FIGS. 3–8.

Figure 3:
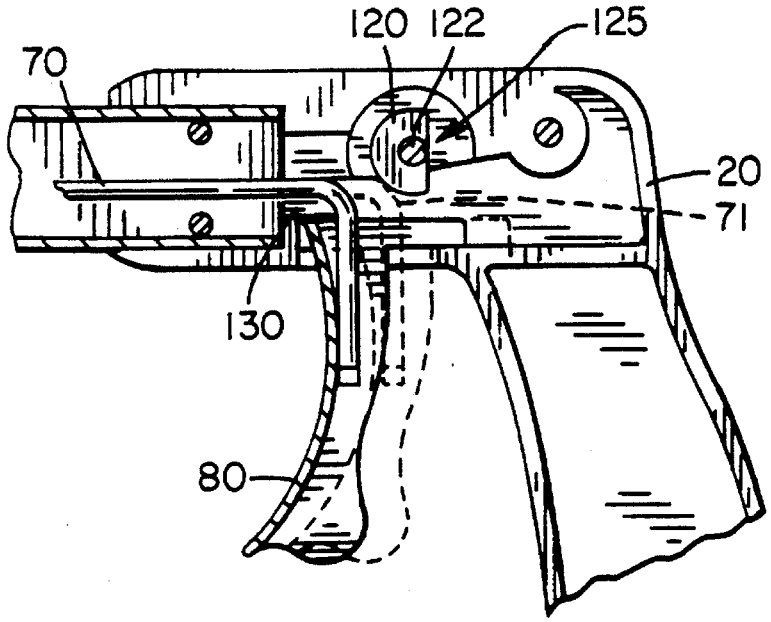
FIG. 3 is a partial view of FIG. 2 showing a trigger and locking mechanism in a non-locking position.

Turning to FIG. 3, the trigger 80 is seen to be mounted within rear housing 20 for reciprocating horizontal movement. In FIG. 3, the trigger 80 and trigger rod 70 are shown in solid lines in a non-discharging position. Rightward movement of the trigger 80, in the sense of FIG. 3 to the position shown in phantom, places trigger 80 in a discharging position, i.e., a position which causes material in the aerosol can to be discharged. During such rightward movement, the bottom of a flat plate portion 81 of the trigger 80 rides along the floor 82 in the interior of the rear housing 20. It should be noted that the positioning of the trigger in the non-discharging position corresponds to the actuator rod being in the non-discharging position, while positioning of the trigger 80 in the discharge position corresponds with the actuator rod being placed in the discharge position.

According to a significant aspect of the invention, the remote spraying device is switchable between two modes. In a first mode, trigger 80 is simply reciprocated between the discharging position and the non-discharging position. Since the biasing spring 100, shown in FIG. 2, biases the trigger rod and thus the trigger to the non-discharging position, the contents of the aerosol can is only discharged, in this mode, when the trigger 80 is being manually held in the discharging position by the user. In a second mode, this same type of conventional manual on-off control of the trigger can be performed. Moreover, the second mode also provides a hands-free continuous discharging operation by allowing a user to lock the trigger 80 into a discharging position. This continuous discharging position of the trigger 80 is shown in phantom in FIG. 4. It can be seen from that figure that the trigger 80 is displaced both horizontally and vertically when it is moved into this continuous discharging position.

Figure 4:
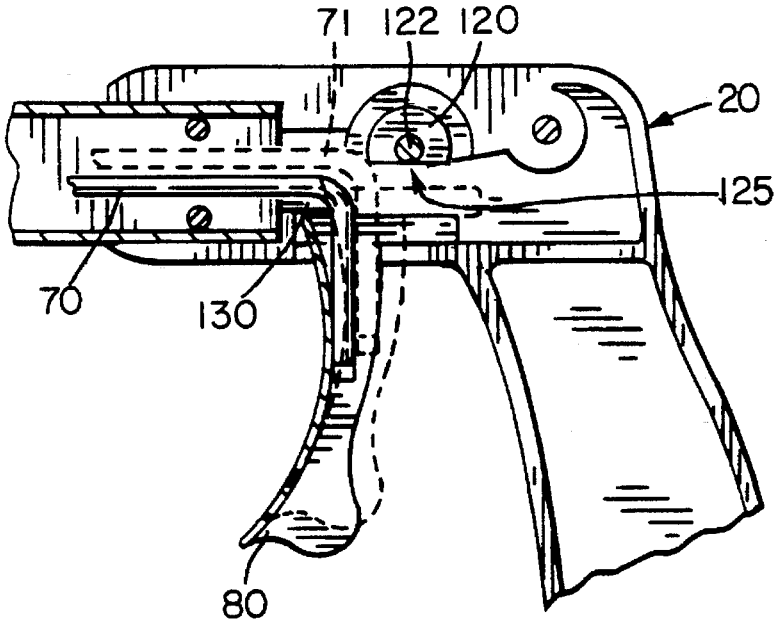
FIG. 4 is a partial view of FIG. 2 showing the trigger and locking mechanism in a locking position.

To determine whether the remote spraying device will be in the first mode (which does not provide for any locking) or the second mode (which does provide for locking) a locker 120 is provided, as seen in FIGS. 3 and 4. Locker 120 is a generally cylindrical member which is rotatable about pivot point 122. Locker 120 extends between the side walls of the rear housing 20. The generally cylindrical locker 120 also includes a flat face 125. The orientation of this flat face 125 determines whether the locker is in a non-locking position, wherein only horizontal movement of the trigger 80 is allowed, or in a locking position, wherein vertical movement of the trigger, so that it can be disposed in the continuously-discharging position, as well as horizontal movement providing for intermittent discharging, is allowed. The two positions are shown in FIG. 5 and FIGS. 6–8, respectively.

Figure 5:
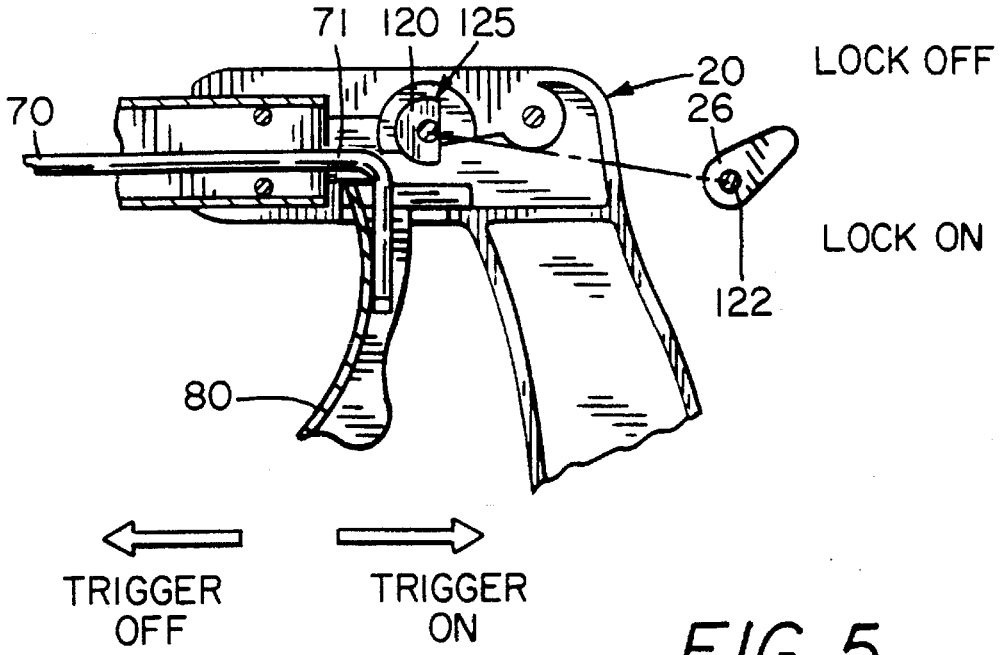
FIG. 5 is a partial view of FIG. 2 showing the range of trigger motion available when the locking mechanism is in the non-locking position.
Figure 6:
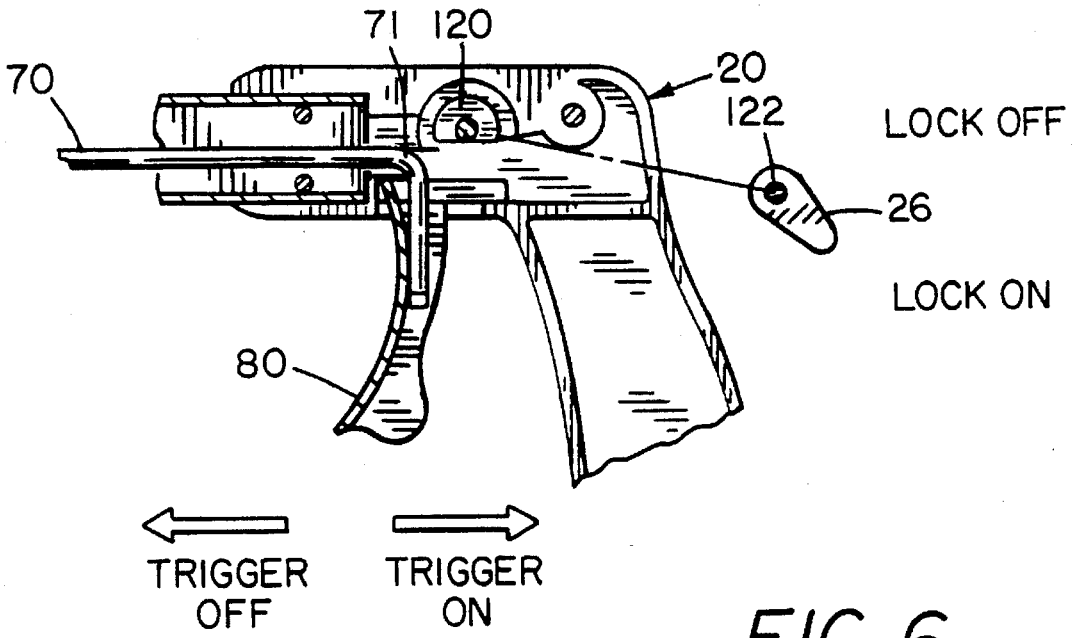
FIG. 6 is a partial view of FIG. 2 showing and indicating a portion of the range of motion of the trigger when the mocking mechanism is in the locking position.
Figure 7:
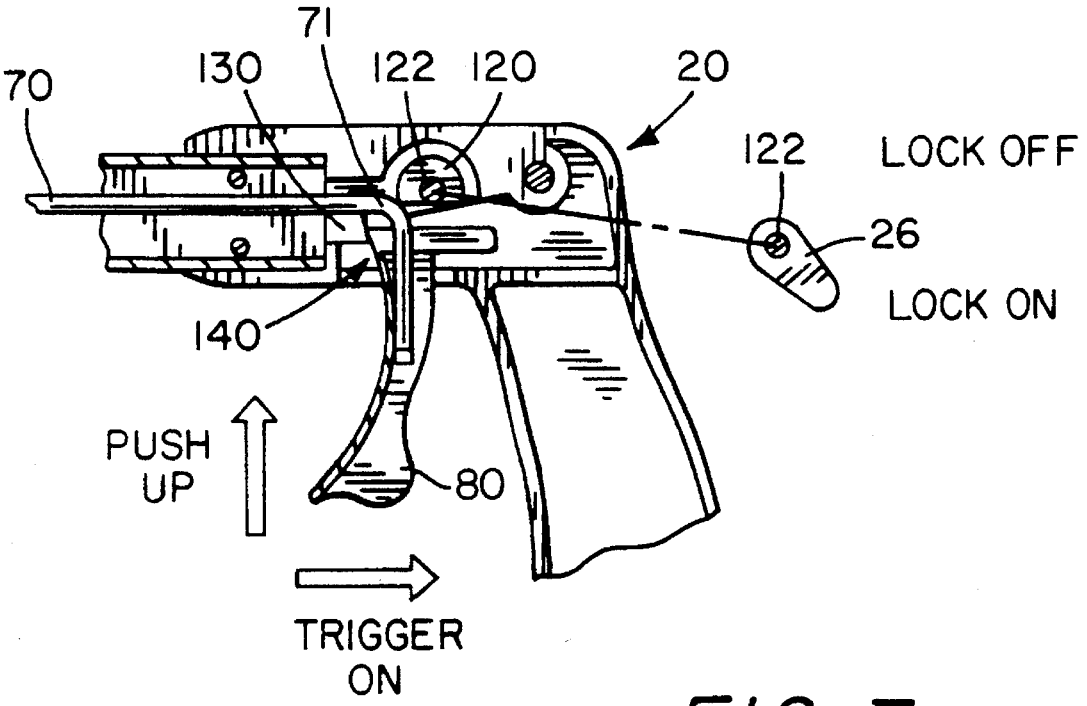
FIG. 7 is a partial view of FIG. 2 showing the trigger and locking mechanism in the locking position and indicating the movement required to place the trigger into the locking position from the non-locking position.

In FIG. 5, the locker 120 is in the non-locking ("OFF") position, with the flat face 125 extending vertically. In that position, vertical movement of the trigger from the discharging position is prevented by the contact of the bend 71 of the trigger rod and the locker 120, as shown in phantom in FIG. 3. In FIGS. 6–8, however, the locker 120 is rotated to a position where the flat face 125 is horizontal. As a result, the locker 120 is not contacting bend 71 in the trigger rod 70, and vertical movement of the trigger 80 to the position shown in phantom in FIG. 4 is possible.

To maintain the trigger 80 in the raised position of FIG. 7 without the need to hold the trigger in that position, a locking land 130 is disposed within the rear housing. With the locking land performing its function of maintaining the trigger in this raised position, the trigger is maintained in a discharging position. As a result, continuous discharge of the contents of the aerosol can is achieved without the need for the user to hold trigger 80 in a discharging position.

The land 130 can be seen most clearly in FIG. 7, which shows the trigger in the raised, continuously discharging position. In a spraying device formed of mirror-image plastic moldings, each molding includes a projection which, when assembled, makes up the locking land. The locking land 130 includes a central gap for allowing passage of the trigger rod 70 when the trigger is in the non-discharging position, as shown, e.g., in FIG. 8. Locking land 130 is designed to frictionally receive a front surface 140 of the trigger when the trigger is moved vertically from the discharging position, as in FIG. 7. The frictional engagement between locking land 130 and front surface 140 of the trigger is enhanced by the biasing spring 100, that spring being shown in FIG. 1. As previously mentioned, the biasing spring 100 bias trigger rod 70 in the leftward sense of the figures. Accordingly, with the trigger 80 in the raised position of FIG. 7, front surface 140 is biased against land 130 by this biasing spring. This biasing, coupled with the frictional engagement between surface 140 and locking land 130 is sufficient to hold the trigger in this raised, continuously discharging position.

The trigger 80 can be returned from this raised, locked position to its normal position within rear housing 20 by the user manually overcoming the friction engagement of locking land 130 and front surface 140, the frictional engagement being enhanced by the effect of biasing spring 100. A rearward pull on the trigger disengages front surface 140 and locking land 130, allowing the trigger 80 to be pulled downward into its normal orientation with rear housing 20, and thus to be released to its non-discharging position.

To provide for selective positioning of the locker 120, and thus to provide for switching of the remote spraying device between the two modes, a lock switch is provided. The lock switch, designated by reference numeral 26 in FIG. 1, and represented in the operational diagrams in FIGS. 5–8, is fixed to the locker 120, and is rotatable about the same axis 122. In this manner, rotation of the lock switch causes a complemental rotation of the locker. The outer surface of housing 20 may include a visual indicator giving an indication of whether the locker is in the non-locking or locking position.

In order to fully explain the operation of the novel trigger mechanism according to the invention, brief reference will be made to FIGS. 5–8. In FIG. 5, the lock switch 26 is seen to be in the OFF position, meaning that the locker 120 is in the non-locking position, which in this case means that flat face 125 is disposed vertically. With the locker 120 in the position of FIG. 5, operation of the remote spraying device in the first mode is provided. As indicated by the arrows in FIG. 5, trigger 80 is horizontally reciprocal between a non-discharging and a discharging position. As previously described, contact of the bend 71 of the trigger rod 70 with the locker 120 prevents vertical movement of the trigger 80 in this mode.

In FIGS. 6–8, the lock switch has been moved to the "ON" position, meaning that the locker 120 has been moved to its locking position, thereby allowing operation of the remote spraying device in its second mode. In this mode, as represented in FIG. 6, reciprocal horizontal movement of the trigger is possible. This is the same movement as can be performed by the spraying device when it is in the first mode. This mode, however, offers the further advantage of continuous discharge without a corresponding continuous squeezing of the trigger by the user. This is because vertical movement of the trigger into the continuous discharging position, as shown in FIG. 7, is allowed to occur.

Figure 12:
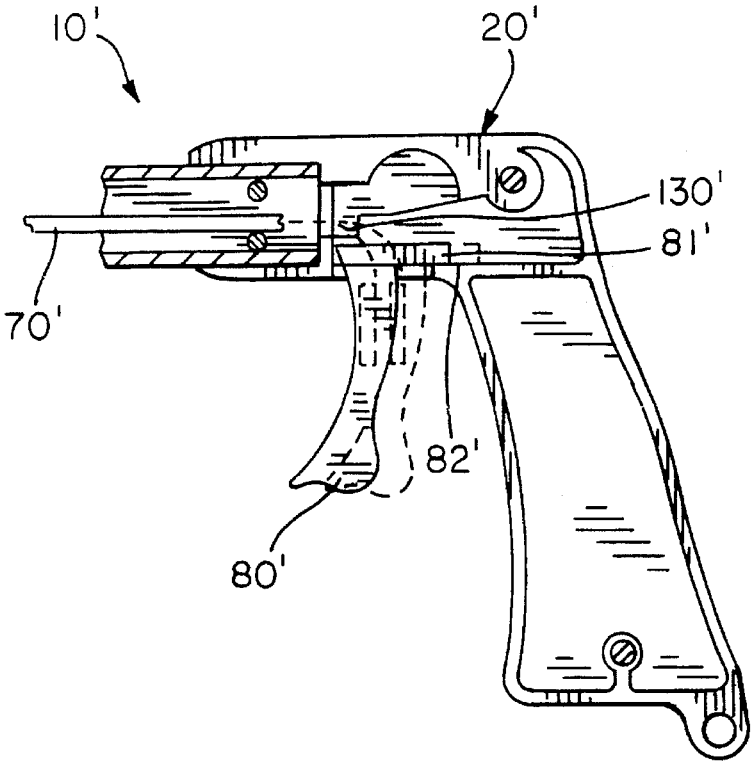
FIG. 12 is a partial view of a trigger and locking mechanism according to an alternative embodiment, and shown in the non-locking position.
Figure 13:
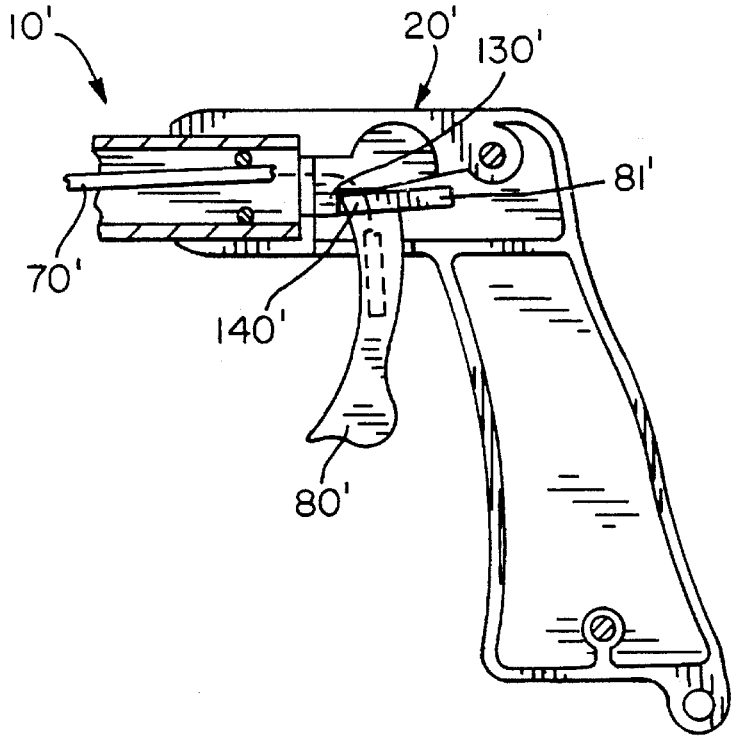
FIG. 13 is a partial view of the alternative trigger and locking mechanism, shown in the locking position.

An alternative embodiment of a locking mechanism according to the invention is shown in the partial section views of FIGS. 12 and 13. The spraying devices depicted there, and indicated by the reference numeral 10', are otherwise identical to the spraying devices 10 according to the previous embodiments, with the exception of lock switch 26 which is not needed for the proper operation of these alternative spraying devices. For the purpose of describing the locking mechanism in FIGS. 12 and 13, reference numerals similar to those used in the previous embodiments, but with a prime symbol following, will be used.

The locking mechanism of the embodiment of FIGS. 12 and 13 differs from the previous locking mechanism in that the locker 120 is not included. However, even in the absence of such locker, it remains possible to lock the device in the discharging position, as well as allow for normal on and off operation between the discharging and non-discharging positions.

To allow for said normal on and off operation, trigger 80' can be reciprocated back and forth as shown in solid and phantom in FIG. 12. As before, trigger rod 70' is biased toward the non-discharging position by a biasing spring (see biasing spring 100 shown in, e.g. FIG.2, but which is not shown here). When spraying device 10' is used in this non-locking mode, the bottom of the flat plate portion 81' of the trigger 80' rides along the floor 82' in the interior of rear housing 20'.

In the locking mode of operation of the spraying device 10' according to this alternative embodiment, trigger 80' can be moved rearwardly and upwardly to a position where it is locked into the actuating position. As before, rearward and upward movement of trigger 80' causes front surface 140' to frictionally engage the locking land 130'. Because of the biasing force of the spring (not shown) the frictional force between front surface 140' and locking land 130' is enhanced, thus allowing the operators hand to be removed from the trigger 80' while the trigger 80' remains in the actuating, locked position. This locked position is shown most clearly in FIG. 13. The locking land 130' comprises two projections, each extending from one sidewall of the rear housing 20', and includes a gap between the projections to allow clearance for the trigger rod 70'. As before, trigger 80' can be removed from this locked, discharging position by pulling back and down on trigger 80'. The backward force on trigger 80' releases forward surface 140' from locking land 130', thus allowing the trigger to be moved downward and forward into the non-discharging position.

Thus, the embodiment depicted in FIGS. 12 and 13 provides a non-locking and a locking mode of operation, but without the need for a locker, or locker switch, as in the previous embodiment. The same advantages apply to this embodiment, with the additional advantage of fewer parts and greater ease of assembly.

The structure and operation of alternative embodiments of a remote spraying device, including the advantageous feature of providing a hands-free continuous discharging function, have thus been described. The molded plastic pieces making up the front sections and rear sections are easily fabricated and assembled, and a minimum number of moving parts makes production and assembly of the remote spraying device simple and cost-effective. The lockable trigger device, in addition to having the advantageous feature of hands-free, discharge of the contents of an aerosol can, is also simple to manipulate into and out of this position, as well as being adapted for normal on and off spraying operation.

While this invention has been described with an emphasis upon a preferred embodiment, it will be obvious to those of ordinary skill in the art that variations of the preferred methods may be used and that it is intended that the invention may be practiced otherwise than as specifically described herein. Accordingly, this invention includes all modifications encompassed within the spirit and scope of the invention as defined by the following claims.

What is claimed is:

1. A spraying apparatus for discharging the contents of a valve-equipped aerosol can comprising:

an elongated, hollow tube having a front and rear end;

a front housing fixed to the tube at the front end, the front housing including a can holder comprising a hollow cylinder sized to receive an aerosol can;

a bell crank pivotally mounted in the front housing;

a trigger rod fixed to a first arm of the bell crank, and mounted within the front assembly and tube for sliding longitudinal movement, such movement causing rotation of the bell crank;

an actuator rod fixed to a second arm of the bell crank and mounted within the first housing for longitudinal movement between a discharging position, wherein the actuator rod pushes the can valve, and a non-discharging position;

a biasing spring fixed between the trigger rod and a retaining wall in the front housing, which biases the trigger rod to a position where the actuator rod is in the non-discharging position;

a rear housing mounted to the rear end of the tube the rear housing including a grip portion;

a trigger disposed within the rear housing and connected to the trigger rod for reciprocating horizontal movement between a discharging position, wherein the actuator rod is in the discharging position, and a non-discharging position; and a locking land disposed within the rear housing for frictionally receiving a front surface of the trigger when it is moved vertically from the discharging position, the biasing spring biasing the trigger into engagement with the locking land and thus maintaining the trigger in the discharging position.

2. The spraying apparatus of claim 1, wherein the locking land comprises two projections from respective sidewalls of the rear housing, the land including a gap between the two projections to allow clearance for the trigger rod.

3. The spraying apparatus of claim 1, further comprising a wheel rotationally mounted on the can holder which contacts the aerosol can and rotates when the can is inserted into the holder.

* * * * *